United States Patent [19]

Matsumoto

[11] Patent Number: 4,715,552

[45] Date of Patent: Dec. 29, 1987

[54] MULTI-SPINDLE WINDER

[75] Inventor: Yukimichi Matsumoto, Hirakata, Japan

[73] Assignee: Kabushiki Kaisha Fuji Tekkosho, Osaka, Japan

[21] Appl. No.: 856,071

[22] Filed: Apr. 23, 1986

[51] Int. Cl.[4] ..... B65H 19/20; B65H 19/16; B65H 19/28

[52] U.S. Cl. ..... 242/56 A; 242/56 R; 242/64

[58] Field of Search ..... 242/55, 55.01, 56 R, 242/56 A, 56 B, 56.9, 196, 201, 207, 208, 64, 65, 67.1 R

[56] References Cited

U.S. PATENT DOCUMENTS

| | | | |
|---|---|---|---|
| 2,736,508 | 2/1956 | Langbo | 242/56 A |
| 3,796,388 | 3/1974 | Davis | 242/56 A |
| 4,326,679 | 4/1982 | Phelps et al. | 242/56 A |
| 4,541,583 | 9/1985 | Forman et al. | 242/56 Z |

*Primary Examiner*—Donald Watkins

*Attorney, Agent, or Firm*—Flynn, Thiel, Boutell & Tanis

[57] ABSTRACT

A multi-spindle turret winder of surface winding—center winding system provided with a first contact roller partaking in initial winding from a first winding station to an intermediate station and a second contact roller partaking in, after change-over from the former, winding-up to roll products from the intermediate station to a second winding station. In order to perform a transparent winding under a constant tension on a stretch film without air being entrapped in roll products, speed control means is provided to impart, immediately before press contact, a peripheral speed slightly faster than the first contact roller to the second contact roller and, after press contact, a peripheral speed gradually increasing at an increment proportional to the turning angle of the turrets during movement from the intermediate station to the second winding station; and a cam is provided which is actuated interlocking with the indexing motion of the turrets and has such a profile that limits a displacement magnitude of the first contact roller so as to increase variations in path length of the film in proportion to the turning angle of the turrets.

2 Claims, 16 Drawing Figures

MULTI-SPINDLE WINDER

BACKGROUND OF THE INVENTION

1. Field of the Invention

This invention relates to a multi-spindle winder of a surface winding—center winding driving system according to which surface winding driving is primarily effected and center winding driving subsidiarily, the winder being provided with multi-spindle turrets having a plurality of winding spindles and being designed to produce continuously roll products consisting of a winding core with a given length of a transparent stretch film wound thereon.

2. Description of The Related Art

In winding up a transparent stretch film onto a winding core, it is required to wind the film under a constant tension throughout the entire process from the beginning to the end of winding so as not to entrap air among film layers of roll products and to obtain, from the viewpoint of good quality, so-called transparent rolls whose innermost core portions are seen through the film layers.

With a multi-spindle winder, operation is conducted so that an empty winding core is supported on a winding spindle provided on multi-spindle turrets at a first winding station; the leading end of a film fed from a delivery station is wrapped around the winding core while subsidiarily driving to rotate the winding spindle, concurrently with which a contact roller driven to rotate is put in contact with the surface of the film to initiate winding mainly by surface winding drive; at the time when most of a given length of the film is nearly fully wound, the multi-spindle turrets are turned a given angle, and simultaneously, the wound core shortly before full winding is transferred to a second winding station which is in a location receding from the first winding station relative to the delivery station and is wound up to a full-wound roll product at the second winding station; during which time a new empty winding core is supplied and ready for the next winding at the first winding station.

Here, it is critical that air be not entrapped among winding layers of the roll products not only under steady-state winding conditions at the stationary definite stations but also during turning motion of the turrets.

With a view to precluding air from being entrained among film layers being wound to form air layers in such manner as stated above, it is a known practice that the contact roller is brought into press contact with the winding contact line on roll products, thereby to intercept, at the inlet of the wound layers of the film, the air conveyed with the film being travelled.

When winding up is conducted at a stationary location, it is easy to effect a winding operation while putting the contact roller in contact with roll products, whereas during turning of the turrets, it is technically difficult to maintain the contact of only one contact roller while moving it to follow the winding station being shifted.

For this reason, a further second contact roller has hitherto been disposed in addition to a first contact roller and used for relay purpose. That is, during the former half turning period of the turrets, the first contact roller is moved in accordance with the movement of the winding station and then relayed to the second contact roller by bringing it into contact with roll products and releasing the first contact roller and subsequently, during the latter half period, the second contact roller is moved as the winding station is moved, whereby at least either of the contact rollers is always put in contact with roll products and the entrapment of air is precluded.

Thus, it is possible to prevent air from being entrapped by using a plurality of contact rollers for the purpose of relay, but nevertheless when notice is taken of tension imposed on the film during turning of the turrets, there are variable factors of the tension as enumerated below.

(A) The winding station gradually moves away from the delivery station with time.

(B) When the contact rollers move, following the movement of the winding station, they are affected by their revolution for following and turning motion as well as their spin rotation to cause the change in winding rotation number since the rotational drive system of them is usually composed of a planetary gear mechanism.

(C) The winding spindle supporting the winding core which is driven to rotate about its own axis is, during turning of the turrets, subject to change in rotation number by means of a planetary gear mechanism as a power transmission element for them.

(D) After the relay of the first contact roller to the second contact roller is finished, the first control roller moves and reverts to the initial first winding station. In the course of returning movement, the first contact roller serves also as a guide roller for guiding the film until the film is severed and hence the length in which the film develops stretching from the delivery station to roll products being wound, namely, the path length of the film is changed.

(E) The nip distances of the film (viz. distances between the nip point at the delivery station and the nip points of the first and second contact rollers) become longer with time during turning of the turrets. When the turrets are moved to the second winding station and stop, the nip distance there is considerably longer than that when winding is conducted at the first winding station.

The foregoing variable factors naturally affect the winding operation to vary the tension of the film. In a winder having such variable factors, it is extremely difficult to perform a winding operation while imparting constantly a definite tension and without air being entrapped among the winding layers. Particularly, in the case of a stretch film, irregularity of the film width and occurrence of local creases on the film are unavoidable and further, winding-up to a transparent roll product is not feasible.

To cope with these problems, attempts have been hitherto made to extremely slow down or stop the feed of film during turning motion of the turrets thereby to stock temporarily the film continuously payed out from the preceding step in an accumulator, but problems have been still encountered in that efficiency of production steps is diminished and creases, unevenness of width or other troubles, occur frequently in the roll products.

Further, by regarding the film portion of a roll product wound during turning of the turrets as a reject portion, after cutting process at the time of final winding-up, that portion only has been unwound and cut off.

This method, however, entails occurrence of loss and further reduction in efficiency, and is not favorable.

Therefore, this invention has for a primary object to provide transparent rolls wound tightly by winding them under a constant tension consistently from the beginning to the end of winding operation while precluding the entrapment of air.

Another object of this invention is to perform winding even in the transitional period during turning of the turrets without diminishing winding speed and to permit sequence well synchronized and linked with the preceding step, thereby to maintain high efficiency of winding treatment.

A further object of this invention is to permit winding of a film stabilized in quality from the beginning to the end of winding and to attain enhancement in productivity and curtailment in cost without causing loss of the film.

SUMMARY OF THE INVENTION

According to this invention, there is provided a multi-spindle winder of surface winding system by means of a first contact roller and a second contact roller as referred to above, which winder is characterized in that when the two contact rollers are moved to follow the turning movement of multi-spindle turrets and winding drive by the press contact is changed over from the first contact roller to the second contact roller, the magnitude of displacement of the first contact roller when returned from an intermediate position between a first and second winding stations to the first winding station is limited so that the path length of the film travelling, pinched between the preceding station and the winding station may increase linearly while peripheral speed of the second contact roller is made slightly faster than that of the first contact roller at the initial speed and, thereafter, is controlled to linearly increase with the movement of the second contact roller, whereby winding to a transparent roll product is permitted while retaining constantly the tension exerted on the film during movement between the first and second winding stations without air being entrapped among winding film layers. Further, the provision of means for cutting the travelling film being wound at high speed and means for wrapping the cut end of the film around a next winding core permits to accomplish an efficient film winding without any loss of film and loss time.

DESCRIPTION OF THE PREFERRED EMBODIMENTS

Figure 1:
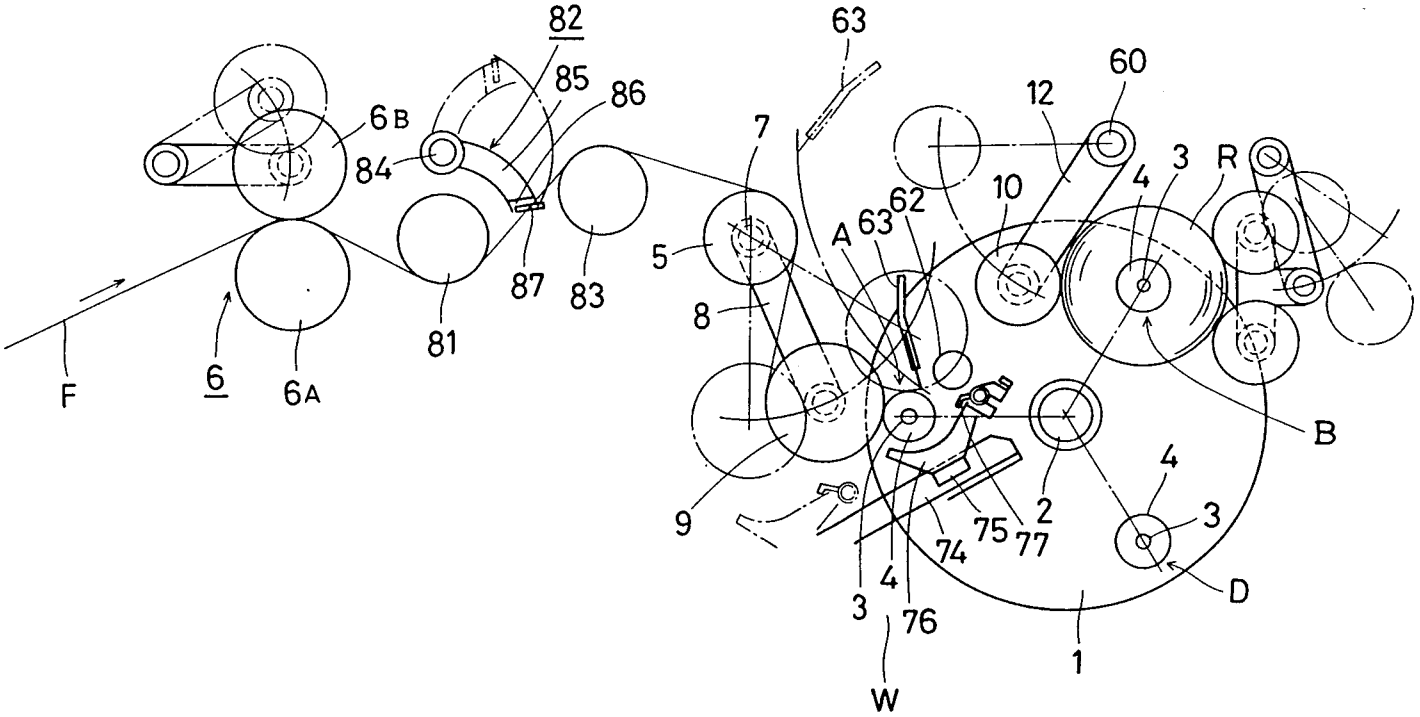
FIG. 1 is a schematic view showing a construction for a continuous winding process pertaining to an example of a winder of this invention.

In FIG. 1, from the upstream side based on the travelling direction of a transparent stretch film (hereinafter simply referred to as film), F, a pair of pinch rollers 6, a guide roller 81, a slitter 82, a guide roller 83 and a multi-spindle turret winder W are arranged in that order.

The pinch rollers 6 consist of a roller 6A having a shaft supported horizontally, which roller 6A is rotatable at a fixed location and a roller 6B oscillatable vertically, while maintaining its axis of rotation horizontally, in order to move from above downwardly into pressing contact with the roller 6A.

The slitter 82 is formed of a pair of arms 85, 85 oscillatable vertically and attached to a shaft 84 rotatably supported at both ends thereof for movement about a horizontal axis. A bar 86 extends between the arms 85, 85 and has fixedly mounted thereon a plurality of cutter blades 87, which blades have mutually parallel cutting edges spaced at predetermined intervals. The cutter blades 87, whose sharp edges are opposed to the travelling film F, serves to slit the film F in the longitudinal direction thereof to form a plurality of films, whereby several elongate films with an appropriate narrow width are obtained from the film F in a wider web form.

The multi-spindle winder W is illustrated in FIGS. 2 to 5 and has sequential operating conditions changing with time and, more particularly, is an example of a 3-spindle winder.

A pair of 3-spindle turrets 1 are disposed bilaterally symmetrically relative to the travelling direction of the film F, the centers thereof journaled on a rotating shaft 2 and are adapted to turn every one third turn at 120° when directions for change of winding are transmitted.

The three-spindle turrets 1 each have three winding spindles 3 which are arranged equidistantly and at equal center angles (120°) relative to the rotating shaft 2 and are formed to be positively rotated and to support and rotate a winding core 4 around the winding spindles 3, whereby center winding is permitted.

On the upstream side of the three-spindle turrets 1, a feed roller 5 is provided at the film delivery station which feed roller 5 is supported for horizontal movement and rotation. The feed roller 5 has the tendency of rotating at the same peripheral speed as the pinch rollers 6 to feed the film F to the winding spindle 3 of the three-spindle turrets 1.

On a shaft 7 supporting the feed roller 5, there are rotatably pivoted the intermediate portions of a pair of oscillatable arms 8 arranged bilaterally. The oscillatable arms 8 are rotatably interconnected by a first contact roller 9 between the top ends thereof on the side of three spindle turrets 1 and, at the opposite rear ends thereof, are engaged with rod ends of a pair of air cylinders 11, 11 attached, in a one-point supporting manner, to the frame of the winder. As the operating stroke of the air cylinders operated in synchronization with each other becomes shorter, the first contact roller 9 approaches the winding spindle 3 located at the first winding station A, whereas as the operating stroke becomes longer, the 1st contact roller 9 recedes from the first winding station A toward the film delivery station. In this manner, the oscillatable arms 8 and the air cylinders 11 form an oscillating mechanism capable of moving the first contact roller 9 toward or away from the winding core 4 supported on the winding spindle 3 at the first winding station A, while maintaining parallelism between the axes thereof.

Each air cylinder 11 has additionally a function of an air spring and is formed, in the example illustrated, of a two-tier structure consisting of two independent front and rear internal compartments. The rear compartment is located on the lower end of the cylinder 11 in FIG. 2 and acts as a spring bringing the first contact roller 9 into press contact with a roll product R which is being wound gradually to a large diameter at the first winding station A, whereas the front compartment causes the first contact roller 9 to move toward or away from the roll product R at the first winding station A and further acts to move the 1st contact roller 9 to follow the roll product R which is shifting from the first winding station A to the downstream side together with the turning motion of the 3-spindle turrets 1 while maintaining the contact of the first contact roller 9 with the roll product R.

On the downstream side of the first contact roller 9, a first contact roller 10 is arranged so as to be oscillatingly movable in parallel relation toward or away from the winding core 4 supported on the winding spindle at the second winding station B by means of an oscillating mechanism comprising arms 12, 12 arranged bilaterally and supported oscillatably on a support shaft 60 and a pair of air cylinders 13 which serve to oscillate synchronously the arms 12, 12.

A pair of the air cylinders 13, 13 are attached to the frame of the winder in a one-point supporting manner and are operated synchronously.

Figure 5:
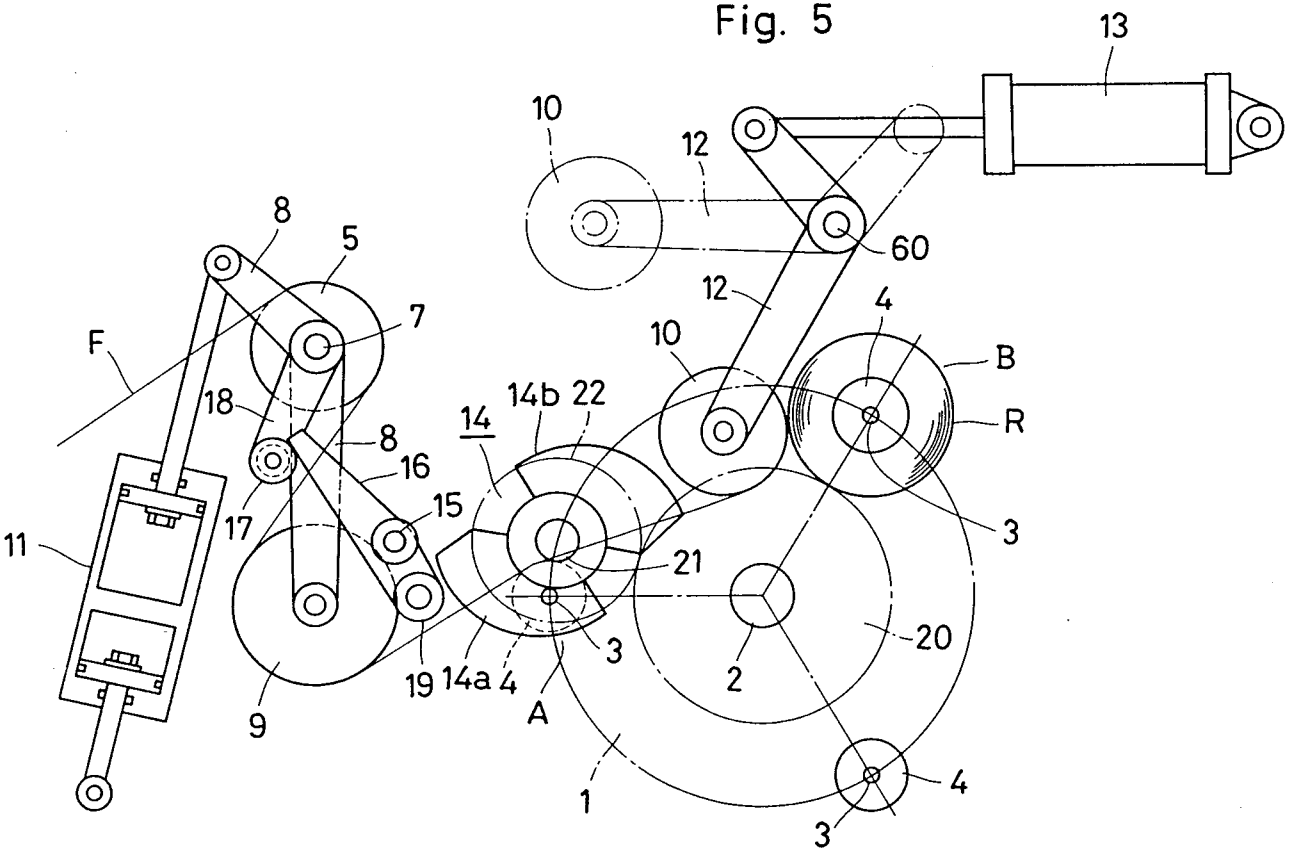

As their operating stroke becomes longer, the second contact roller 10 approaches the winding core 4 from above and moves to follow the roll product R being wound which is shifting from an intermediate position, or station C between the first winding station A and the second winding station B, to the second winding station B away from the film delivery station, while making contact with the surface of the roll product R, whereas as the operating stroke becomes shorter, the second contact roller 10 recedes upwardly away from the second winding station B (Cf. FIG. 5).

The first winding station A and the second winding station B are located equidistantly from the rotating shaft 2 which is at the center of the three spindle turrets 1 at a rotating angle of 120° and the first winding station A is nearer to the feed roller 5 on the film delivery side than the second winding station B as illustrated. The intermediate station C is located at 60°, bisecting the rotating angle of 120° defined by the first and second winding stations A and B.

Then, when the three spindle turrets 1 are turned 120°, the roll product R existing at the first winding station A is moved to the second winding station B while continuing to wind the film, concurrently with which an empty winding core 4 supported on the winding spindle 3 at a stand-by station D is moved to the first winding station A, and the film F is severed with a cutting device, as later described, in the neighborhood of the empty core on the downstream side of the first winding station A and simultaneously, the leading end of the film is wrapped around the empty winding core 4 located at the first winding station A.

The winding operation during the process of moving the roll product R being wound from the first winding station A to the second winding station B is one of the essential features of this invention and is performed through 3 stages as stated below.

Figure 2:
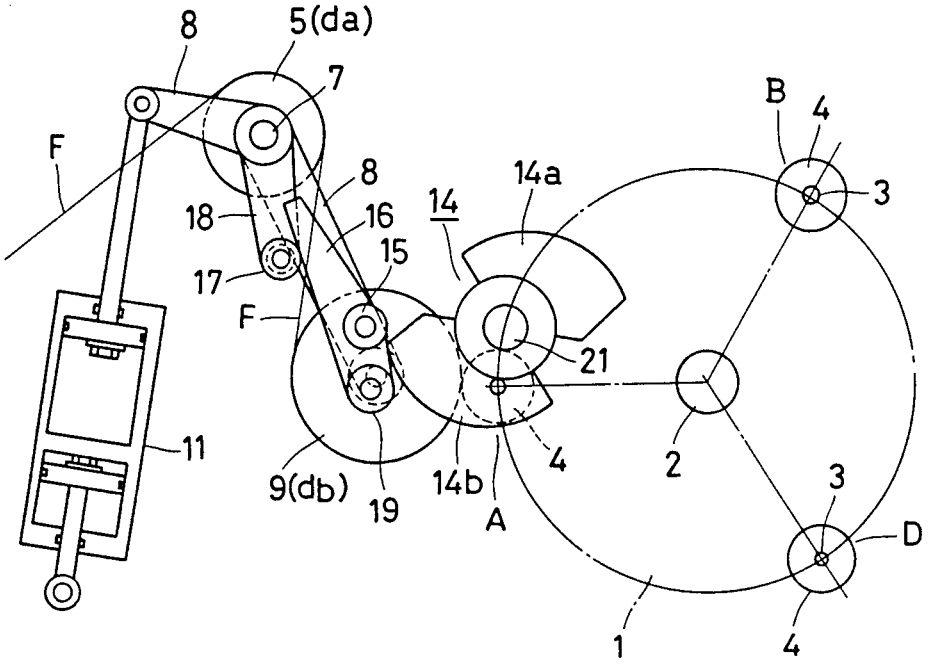
FIG. 2 through FIG. 5 are each a schematic view of a construction showing a part of the winder illustrated in FIG. 1, and show sequential operation conditions varying with time.
Figure 3:
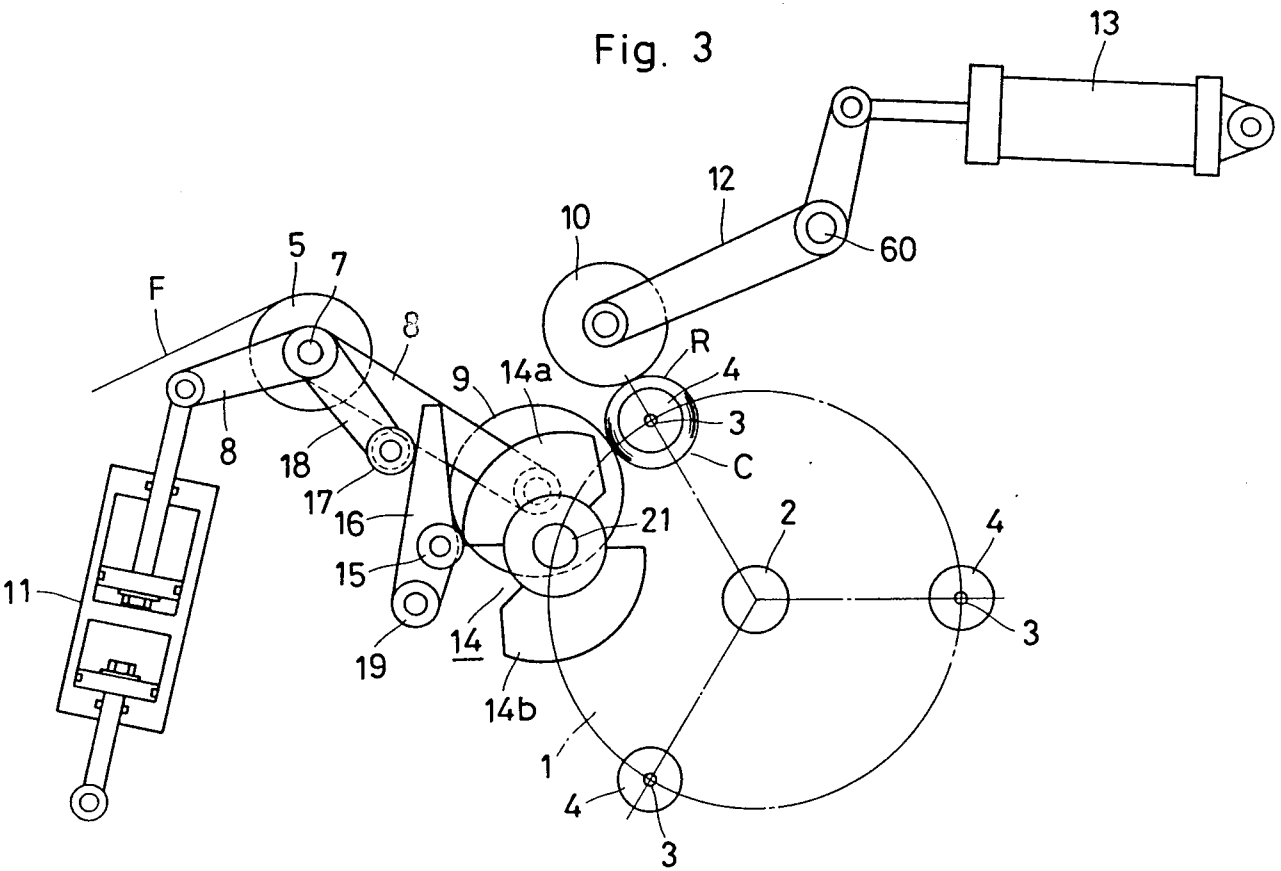

(I) The state in which the first contact roller 9 only is in contact with the roll product R. When the three spindle turrets 1 are turned 60° from the first winding station A as shown in FIG. 2, the roll product R being wound is moved to the intermediate station C as shown in FIG. 3. This period is called the first stage.

(II) The state in which the first contact roller 9 and second contact roller 10 cooperate together to make contact with the roll product R. As illustrated in FIG. 3, the second contact roller 10 descends to come in press contact with the roll product R with which the first contact roller 9 is in contact, and this period is called second stage.

Figure 4:
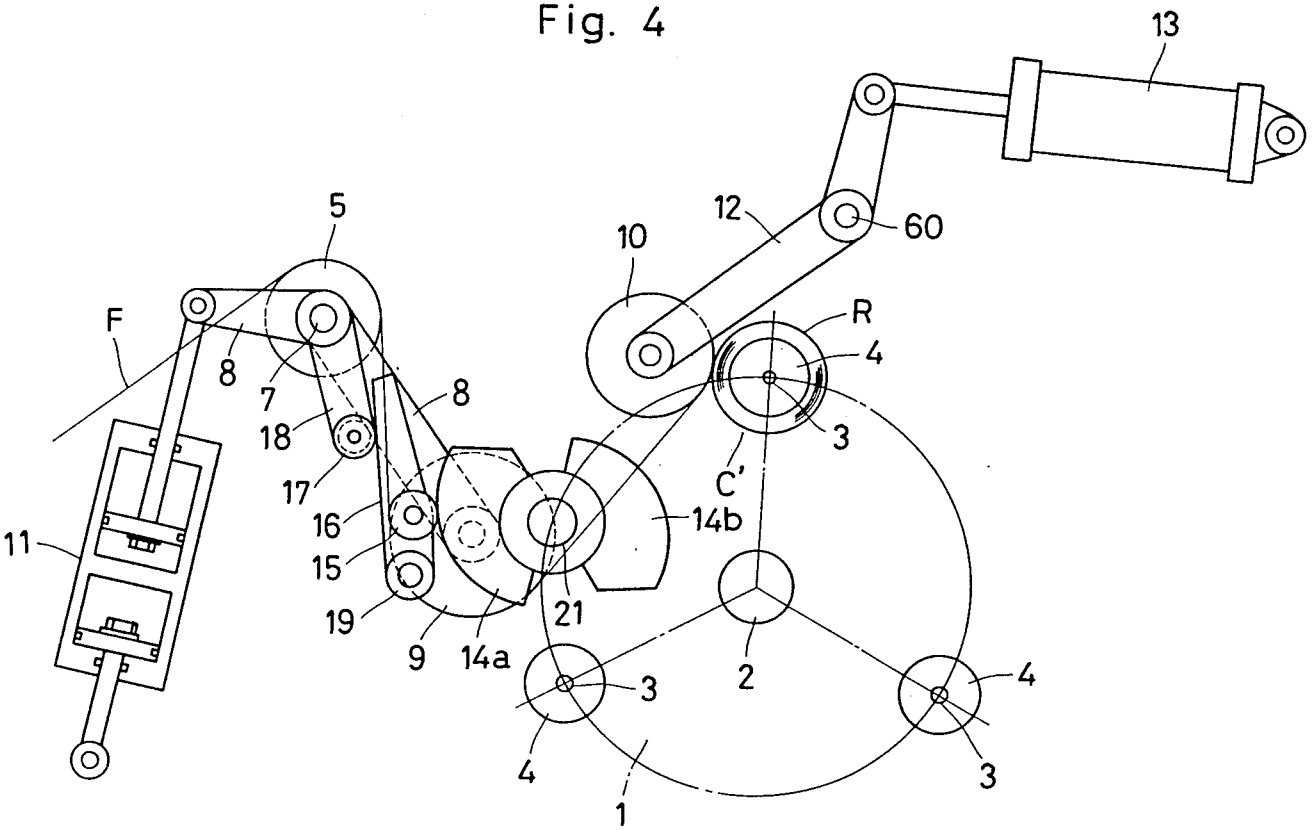

(III) The state in which only the second contact roller 10 is in contact with the roll product R. The first contact roller 9 moves clear of the roll product R and returns to the original position as illustrated in FIG. 4 while the three spindle turrets 1 are further turned to move the roll product R to the second winding station B, which state is shown in FIG. 5. This period is called the third stage.

The foregoing three stages will be analyzed in more detail.

(I) First Stage:

As stated in the variable factor (C) above, the first contact roller 9 effects both spin rotation by forced driving and revolution around the shaft 7 of the feed roller 5.

When a power of clockwise rotation introduced to the shaft 7 of the feed roller 5 is transmitted to the first contact roller 9 with the aid of a suitable driving gear such as a roller chain, gear or the like so that the first contact roller 9 may effect a counterclockwise rotation and its rotation ratio may be a diameter ratio of the feed roller 5 to the first contact roller 9 whereby the peripheral speed of it is brought into agreement with the feed speed of the film F, the driving gear constitutes naturally a differential gear device wherein an oscillating slider crank mechanism is formed by the oscillatable arms 8.

In FIG. 2, let the diameters of the feed roller 5 and the first contact roller 9 be $d_a$ and $d_b$, respectively. In the case where the rotation ratio of both rollers 5, 9, namely $a:b$ is set to be $d_a:d_b$, the clockwise rotation direction is expressed in a positive value and the counterclockwise rotation direction in a negative value, and rotation of the feed roller 5 is set to zero for the purpose of easy understanding, it will be apparent from the principle of rotation of a differential gear device that when the oscillatable arms 8 are rotated a value of $-\theta$, the first contact roller 9 is rotated $\theta(a/b-1)$.

On the other hand, the length of the film F stretching between the feed roller 5 and the first contact roller 9 does not change in the least without being affected by the oscillation of the oscillatable arms 8.

It follows from the above that the following consideration is led.

By reason of the principle of planetary gear mechanism, the travelling film F stretching between the feed roller 5 and the first contact roller 9 is not affected by the turning movement of the oscillatable arms 8 at all, and the variation of rotation of the first contact roller 9 caused by the turning movement is transmitted to the roll product R which is being wound and being rotated in contact with the roller 9.

However, the driving source for the winding spindles 3 is provided with a variable speed performance essential to the central winding drive system, namely a rotation control performance for retaining a constant tension and hence, speed control absorbing the variation of rotation is performed without any problem.

Again, since the winder is constructed so that winding is effected while perpetually maintaining the contact with the contact roller, any influence of speed variations as mentioned in the variable factor (B) above need not be considered. Thus, winding actuation maintained under a constant tension can be effected in good order.

There occurs no problem in the first stage.

(II) Second Stage:

Insofar as the first contact roller 9, the second contact roller 10 and the roll product R are driven so that respective surface speeds are the same, there occurs no problem.

However, it is preferred, in the designing stage, to preliminarily set the driving speeds of the first and second contact rollers so that the speed of the second contact roller may be a little faster than that of the second contact roller as later described.

(III) Third Stage:

This stage requires most careful considerations. At this stage, the three spindle turrets 1 are turned, whereby:

(i) The winding station A recedes, with time, away from the feed roller 5 which is at a fixed point on the delivery station side.

(ii) After the second contact roller 10 comes in contact with the roll product R, the first contact roller 9 reverts to the initial position. At the instant when the first contact roller 9 moves clear of the roll product R, the distance from the fixed feeding point to the winding station, namely the distance from the feed roller 5 to the contact line of the second contact roller 10 with the roll product R is abruptly changed to being longer.

(iii) As the first contact roller 9 reverts to the initial position, the length of the film F from the feed roller 5 to the contact line of the second contact roller with the roll product R varies with time and becomes longer. Additionally, recession of the winding station away from the feed roller 5 further lengthens the path length of the film F from the feed roller 5 to the contact line of the second contact roller 10 with the roll product R.

Now, the relation between a stretch film and tension will be discussed.

When a stretch film is conveyed at a certain draw ratio (i.e. a speed ratio of the feed side to the drawing side) between two points, the longer the distance between the two points, namely, the path length is the more the tension exerted on the film is lowered.

Figure 13:
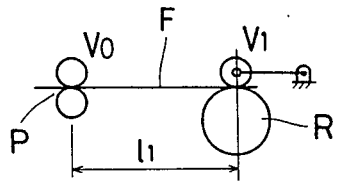
FIG. 13 through FIG. 15 are each an illustration showing the relation between variations in path length and variations in draw ratio.
Figure 14:
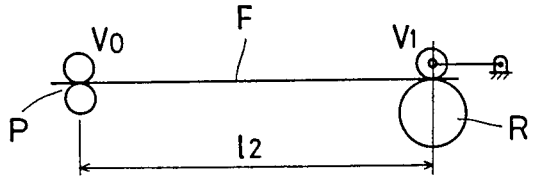
Figure 15:
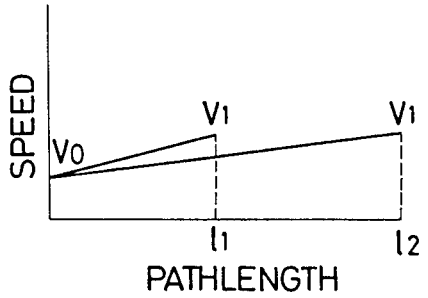

In FIG. 13 to FIG. 15, suppose that while the film is fed out by means of the pinch rollers P at a speed of $V_o$ and a draw is applied to it at a little larger speed $V_1$ than $V_o$, surface winding to the roll product R is performed. The gradient of speed change to the film F straining between the pinch rollers P and the winding position is naturally different between the case where the distance from the pinch rollers P to the winding position is $l_1$ (FIG. 13) and the case where the distance is $l_2$ ($l_2 > l_1$) (FIG. 14), the latter case having a more gentle gradient (see FIG. 15).

Stated another way, the tension imposed on the film F varies depending on the distance ($l_1$, $l_2$) even if the film F is drawn under the condition of the same draw ratio, the tension of the longer distance ($l_2$) being smaller than that of the shorter distance ($l_1$). As a corollary, at the third stage when the path length becomes gradually longer with the turning movement of the turrets, the tension imposed on the film F decreases. As a result, the film F thus wound is wider in width in the latter, upper winding layers and the border portion of the film in the upper winding layers is liable to be involved in the lower winding layers, which leads to a disadvantage of the film F being ruptured when the roll product is rewound in the subsequent step.

Hence it is essential to render the tension applied to the travelling film F conveyed between two points constant and to that end, the gradients of speed variations must be equalized irrespective of long or short path lengths.

This requirement signifies that during the period of time when the three spindle turrets are turned a rotation angle of 60° from the intermediate position C to the second winding station B, it is necessary to increase the peripheral speed of the second contact roller 10 with time.

Further, it is required that the instant that the first contact roller 9 is released from the roll product R, the peripheral speed of the second contact roller 10 be changed to a faster speed to accommodate the variations of path length. The variations of path length here are not a linear change since the winding position traces a locus of a circle centered on the rotating shaft 2.

The returning movement of the first contact roller 9 is also a locus of a circle centered on the feed roller 5, hence the change of path length incident to the returning movement is not a linear change, either.

Here, if the first contact roller 9 is simply returned to the initial position only by the air cylinders 11, the change of path length will run into an uncontrolled condition.

Therefore, from the viewpoint of the description above, it is required to fulfil the following two requirements for a winder of such kind that the winding position is transferred during the winding process:

(1) The return movement of the first contact roller 9 to the initial position is corresponding to the turning position of the three spindle turrets 1 and the return speed is regulated so that the path length may be changed longer in linear manner with the turning of the turrets 1.

(2) The peripheral speed of the second contact roller 10 is linearly increased in agreement with the turning movement of the three spindle turrets 1, and in order to cope with the abrupt change of path length at the moment when the first contact roller 9 is released, the peripheral speed of the second contact roller 10 is preliminarily made faster before releasing.

Now description will be made of examples embodying a winder apparatus which is capable of performing the operation and actuation meeting the foregoing two requirements with reference to the accompanying drawings.

In connection with the aforesaid requirement (1), a mechanism of returning and oscillating the first contact roller 9 so as to increase the path length of the film in proportion to the turning angle of the three spindle turrets 1 is illustrated in FIGS. 2 to 5.

The return mechanism for the first contact roller 9 is rotatably mounted on the frame near the first winding station A and comprises a cam 14 consisting of a pair of cam pieces 14*a*, 14*b* located axially symmetrically and having a definite profile, a cam lever 16 having in its middle portion a first cam follower 15 adapted to come in contact with the surface of the cam 14, and a lever 18 which has at its top end a second cam follower 17 adapted to come in contact with the terminal portion of the cam lever 16 and is attached, at its rear end, to the shaft 7 of the feed roller 5, thereby to be oscillatable together with the oscillatable arm 8.

The cam 14 is mounted on the frame to be rotatable by means of a central shaft 21 located at the center thereof and has a gear wheel 22 fitted on the central shaft 21 (Cf. FIG. 5). The rotating shaft 2 is fitted thereon with a gear wheel 20 in mesh with the gear wheel 22 so that the gear wheel 20 is rotatable unitedly with the three spindle turrets 1. By choosing the gear ratio of the gear wheel 20 to the mating gear wheel 22 appropriately, it is possible to alternately bring a pair of the cam pieces 14*a*, 14*b* into contact with the first cam follower 15 every time when the three spindle turrets 1 are turned 120°.

The cam follower 16 is capable of oscillating around a shaft 19 of the first contact roller 9 by fitting the rear end thereof on the shaft 19.

As the first cam follower 15 is forced to recede from the first winding station A by the contact with the face of the cam piece 14*a* or 14*b*, the top end of the cam lever 16 oscillates and causes the lever 18 to turn around the shaft 7 through the second cam follower 17.

The oscillating arms 8 oscillate in a direction urging the spring pressure of the air cylinders 11 as the lever 18 is turned and consequently, it is possible to operate so that the first contact roller 9 may recede from the intermediate station C toward the film delivery station side.

When the first cam follower 15 is disengaged from the cam piece 14*a* or 14*b* of the cam 14, the oscillating arms 8 oscillate in a direction approaching the first winding station A and move the first contact roller 9 so as to bring it into press contact with the winding core 4.

The profiles of the cam pieces 14*a*, 14*b* are required to fulfill the conditions that the path length of the film F, extending from the contact line thereof to the feed roller 5 via the circumferential face of the first contact roller 9 to the winding contact line of the roll product R, being shifted toward the second winding station B and gradually increased in proportion to the turning angle of the three spindle turrets 1. These conditions can be sought by taking account of and analyzing the position relation between the rotating shaft 2 of the turrets 1 and the feed roller 5, oscillating radius of the first contact roller 9, turning speed of the turrets 1, etc. For instance, it is possible to seek positions of the first contact roller 9 varying with time by calculation technique and to control the air cylinders 11 in conformity with the positions, but such means is complicated and disadvantageous. It is therefore favorable in practice to dispose a cam 14 profiled in a predetermined form by preliminarily designing and drawing and to actuate the cam 14 while interlocking with the turning movement of the three spindle turrets 1.

In order to meet the requirements (2), it is possible to utilize a nonstep variable speed gear 39 as a mechanism for increasing the rotation speed of the second contact roller 10 by variation values of the path length of the film F.

Figure 11:
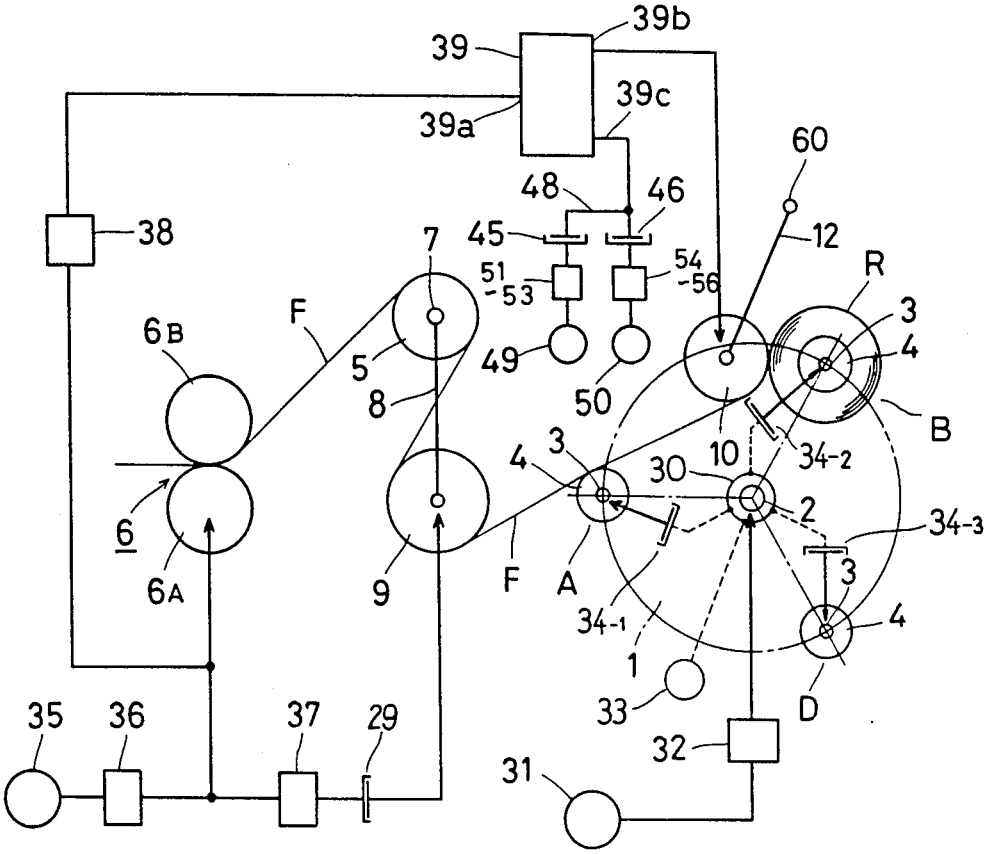
FIG. 11 and FIG. 12 are each a diagrammatical view showing a drive system pertaining to an example of the winder of this invention.
Figure 12:
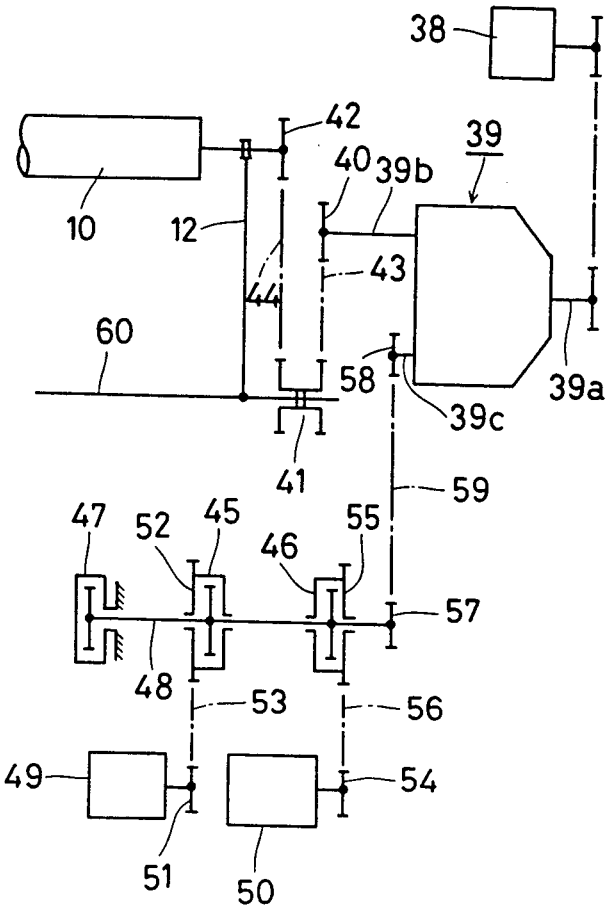

The driving system for the overall winder containing the nonstep variable speed gear 39 will be hereinbelow described with reference to FIG. 11 and FIG. 12.

A mechanism for turning the three spindle turrets 1 at a rotation angle of 120° comprises a motor 31 and a reduction gear 32 and is adapted to transmit the rotation of the motor 31 to the rotating shaft 2 by reducing the speed of it by means of the reduction gear 32.

A driving mechanism for permitting constant tension winding about each of the winding spindles 4 on the three spindle turrets 1, for example, comprises a torque motor or any other torque-controllable motor 33 and three clutches $34_{-1}$, $34_{-2}$, $34_{-3}$ corresponding to the respective winding spindles 4. The torque motor 33 is fixed to the frame and serves, on the one hand, to transmit the rotation of the outlet shaft to a sprocket 30 with a plurality of gear trains rotatably mounted on the rotating shaft 2 through a chain and, on the other hand, to transmit the rotation of the sprocket 30 through a chain to the inlet shafts of the clutches $34_{-1}$ to $34_{-3}$ linked to the winding spindles 4 at one ends thereof. Thus it is possible to impart the rotational power to the winding spindles 4 being shifted from the frame side, which facilitates a tight rolling effect required for rolling of transparent roll products.

A driving mechanism for positively rotating the pinch rollers 6 disposed on the upstream side of the winder comprises a motor 35 and a reduction gear 36 which facilitates a reduction of the speed of rotation of the motor 35 by means of the reduction gear 36 to transmit it to the shaft of the roller 6A whereby two rollers 6A, 6B making press contact with each other are rotated at a peripheral speed synchronized with the travelling speed of the film F being fed from the preceding step.

A driving mechanism for positively rotating the first contact roller 9 comprises a variable speed gear 37 whose inlet shaft is linked to the outlet shaft of the reduction gear 36 and a transmission gear disposed between the shaft 7 of the feed roller 5 and the shaft of the first contact roller 9, and serves to transmit the rotation of the reduction gear 36 through the variable speed gear 37 and the transmission gear to the shaft of the first contact roller 9 thereby to rotate the first contact roller 9 at a slightly faster peripheral speed than the pinch rollers 6.

On the other hand, a driving mechanism for positively rotating the second contact roller 10 comprises a reduction gear 38 whose inlet shaft is linked to the reduction gear 36, the nonstep variable speed gear 39 whose inlet shaft 39*a* and outlet shaft 39*b* are linked respectively to the outlet shaft of the reduction gear 38 and the shaft of the second contact roller 10, and a speed control line having two series of variable speed actuating lines provided in association with an actuation shaft 39*c* for effecting speed change of the nonstep variable speed gear 39.

The outlet shaft 39*b* of the nonstep variable speed gear 39 is formed to transmit the rotation to the second contact roller 10 through a differential gear device which comprises a sprocket 40 mounted on the outlet shaft 39*b*, a sprocket 41 with 2 gear trains rotatably mounted on the support shaft bearing the arms 12, a sprocket 42 mounted on the shaft of the second contact roller 10 and a chain 43 interlinking the sprockets 41, 42.

The speed control line is made up of a rotating shaft 48, a first clutch 45 and a second clutch 46 wherein the outlet side wheel is mounted on the rotating shaft 48, a brake 47 whose wheel is mounted on the rotating shaft 48, a first pilot motor 49 having a sprocket 51 mounted on the outlet shaft thereof, a second sprocket motor 50 having a sprocket 54 mounted on the outlet shaft thereof, a chain 53 linking the sprocket 51 and a sprocket 52 mounted on the inlet shaft of the first clutch 45, a chain 56 linking the sprocket 54 and a sprocket 55 mounted on the inlet shaft of the second clutch 46, and a chain 59 linking a sprocket 57 mounted on the rotating shaft 48 and a sprocket 58 mounted on the actuation shaft 39c of the nonstep variable speed gear 39.

In this speed control line, the second contact roller 10 is preliminarily set to rotate at the same peripheral speed as the first contact roller 9 by causing the rotating shaft 48 to revolve by suitable means to rotate the actuation shaft 39c, with the actuation shaft 39c being in a stationary state, and when the three spindle turrets 1 are turned, control is performed so that first stage of speed increase is effected by the rotation of the first pilot motor 49 to actuate the first clutch 45 and second stage of speed increase is effected by the rotation of the second pilot motor 50 to actuate the second clutch 46. This control will be later described in detail.

The winder is further provided with an automatic cutting device for severing the film F and a wrapping device for wrapping the leading end of the cut film around a new winding core 4.

The automatic cutting device is shown schematically in FIG. 1 and further shown for the details in FIG. 6 through FIG. 10. It comprises arms 61, 61 which are rotatably supported on the both ends of the support shaft 60 supporting a pair of the arms 12, 12 and are adapted to be oscillatable from above, at the free end thereof, so as to be moved toward or away from the winding core 4 at the first winding station A; a roller 62 for pressing the film disposed extending between the free ends of both arms 61, 61; and a cutting unit 63.

The press roller 62 for pressing the film is disposed at such a location that the roller 62 is capable of contacting with the film F stretching from the surface of the empty core 4 to the roll product R at the second winding station B against the film portion near the winding core 4 from above when the arms 61, 61 move to the descending limit position.

The cutting unit 63 is composed of a rail 64 mounted so as to extend between the arms 61, 61. A slider 65 is provided having 4 rollers provided within the rail 64 so as to be slidably movable along the guide face of the rail 64. A support plate 66 is provided for attaching a cutter blade, which plate is attached to the slider 65, facing downwardly. A cutter blade 67 is fixed to the support plate 66 at the lower end thereof. An air gun 68 is attached to the rail 64 on the one end side thereof. A shock absorber 69 is attached to the rail 64 on the other end thereof, and a rodless cylinder 70 is disposed to extend adjacent to and in parallel to the whole length of the rail 64.

The air gun 68 is provided with a cylinder 71 which is closed at one end and opened at the other end and to which compressed air is to be admitted. A runner 72 consisting of a piston is adapted to be slidably received in the cylinder 71. A rod portion extends from the piston portion. The runner 72 is fixed at the rod portion to the slider 65 and is adapted to be movable back and forth between the retracting position where the piston portion is received in the cylinder 71 and the advancing position where the rod portion is shot by the supply of compressed air to run at high speed along the rail 64 together with the slider 65 until it may bump against the shock absorber 69 on the opposite side.

The rodless cylinder 70 has a dog 73 fixed to the piston, the dog 73 being projected on the side of the slider 65 so as to be capable of contacting with the opposite end of the slider 65 to the shock absorber 69. The rodless cylinder 70 serves to cause the slider 65 moved on the side of shock absorber 69 to retract from the shock absorber 69 by the supply of compressed air and to cause the runner 72 to revert to the retracting position. After returning, the runner 72 is latched in that position and is ready for the next film cutting work by, immediately before it, shifting the dog 73 to the shock absorber 69 side.

Figure 6:
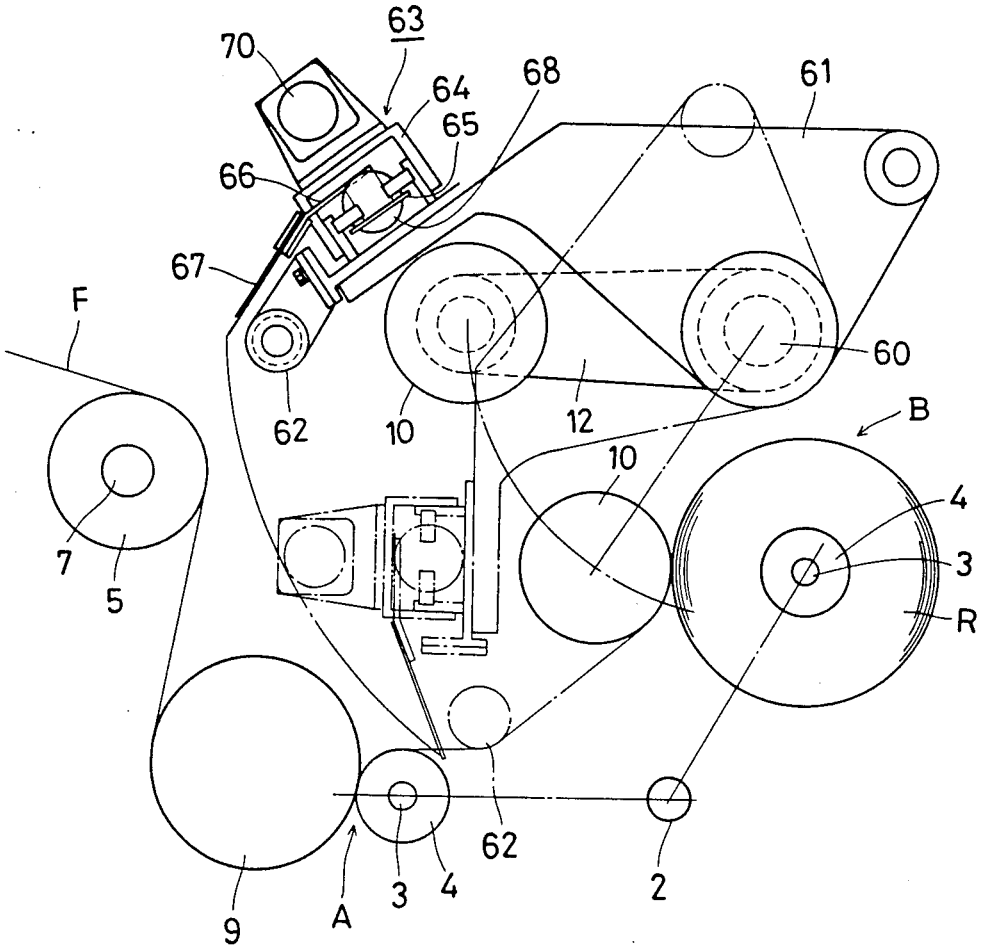
FIG. 6 is a view of an automatic cutting device in FIG. 1.
Figure 7:
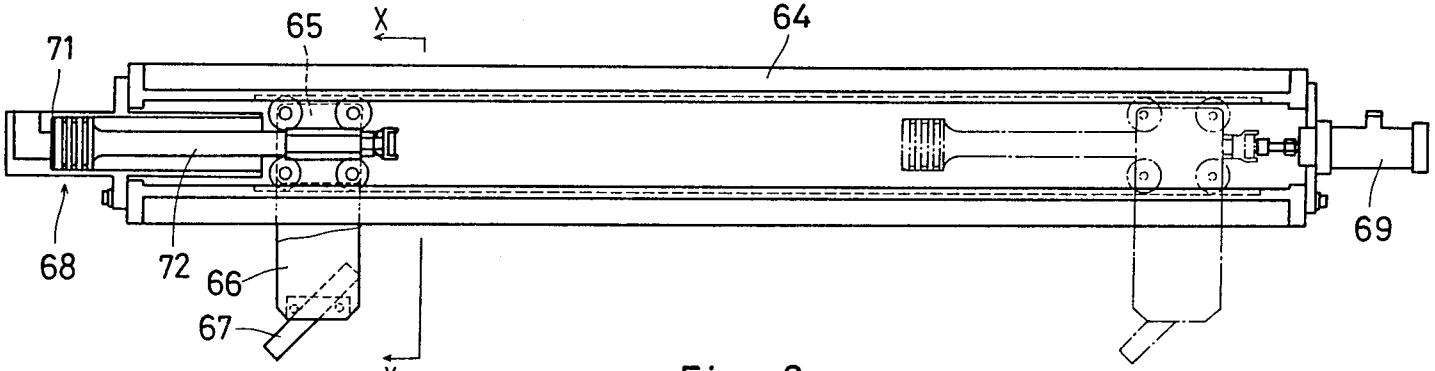
FIG. 7 is an elevational view of the automatic cutting device in FIG. 6.
Figure 8:
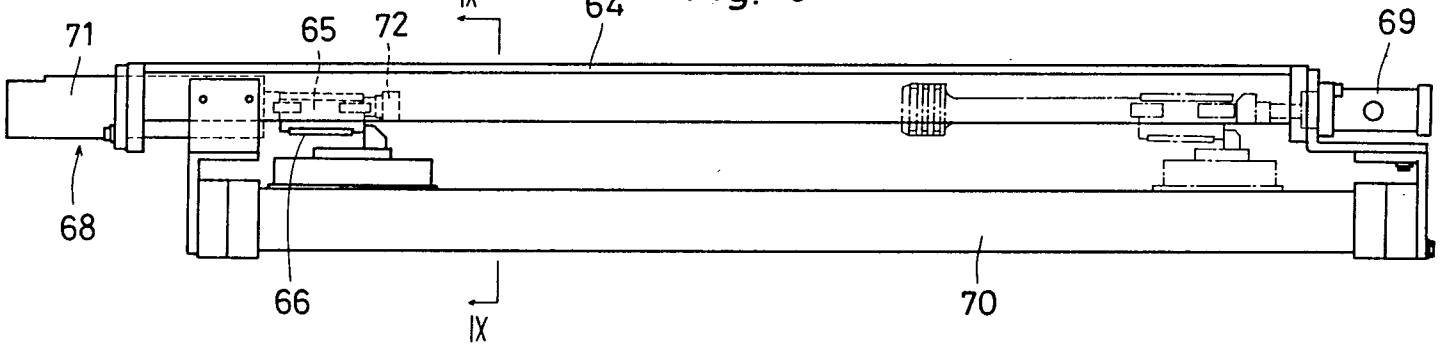
FIG. 8 is a top plan view of the automatic cutting device in FIG. 6.
Figure 9:
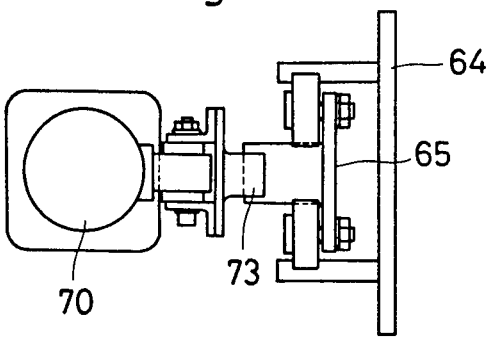
FIG. 9 is a side elevational view taken along the line IX—IX of FIG. 8.
Figure 10:
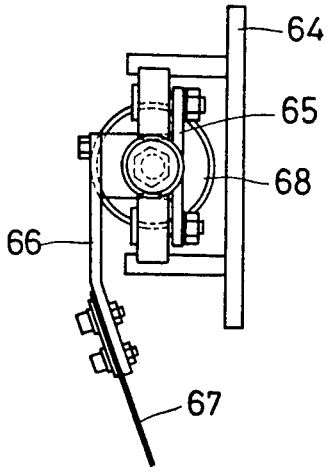
FIG. 10 is a side elevational view taken along the line X—X of FIG. 7.

With the automatic cutting device constructed as described above, when the film F is required to be severed in the width direction, it is possible to cause the cutting unit 63 to descend to the position illustrated in the dot-dash line in FIG. 6 by oscillation, and then to traverse the cutter blade 67 at high speed to sever the travelling film F slantwise by the supply of compressed air into the air gun 68. Here, the slant angle of the cutting line to the width direction of the film F is naturally determined depending on the relation between the speed of the cutter blade 67 and the travelling speed of the film F, and it is possible to make the slant angle a small angle on the order of 10° by running the cutting blade 67 at a high speed by means of the air gun 68.

The wrapping device is composed, as schematically shown in FIG. 1, of a pair of rails 74, 74 disposed downwardly of the winding core 4 at the first winding station A outside of a pair of the three spindle turrets 1 and extending upwardly slantwise toward the rotating shaft 2, a runner 75 mounted, spanned between the rails 74, 74 so as to be slidable along the guide faces of the rails 74, 74, a film guiding member 76 mounted fixedly on the runner 75 and provided with a downwardly arcuate guide face capable of approaching and surrounding the lower circumferential surface of the aforementioned winding core 4, and a plurality of air nozzles 77 attached along the marginal end of the film guiding member 76 on the side of the rotating shaft 2. The air nozzles 77 are disposed dispersedly at suitable intervals along the marginal end of the film guiding member 76 extending toward the shaft of the winding core 4, with the air jet spouts or nozzles oriented toward the arcuate guide face so that air may be injected toward it.

The wrapping device thus constructed is actuated in cooperation with the automatic cutting device. That is, the descending movement of the cutting unit 63 is interlocked with the advance movement of the runner 75, whereby the film guiding member 76 is moved to the position shown in the solid line in FIG. 1, and the traverse actuation of the cutter blade 67 is interlocked with the injection of air from the air nozzles 77.

In this manner, it is possible to guide the film F hanging down from the winding core 4 at the first winding station A upon cutting with the aid of the cutter blade 67 to the space between the guide face of the film guiding member 76 and the lower peripheral face of the winding core 4 by the air flow injected from the air nozzles 77 and further to feed the leading end of the film F to the contact area of the first contact roller 9 and a next winding core 4, thereby to wrap it around the winding core 4.

OPERATION

The mode of operation of the winder will now be described.

At the first winding station A, winding of the film F is performed by surface winding driving to the winding core 4 by means of the first contact roller 9 and by tight winding driving by means of the winding spindles 3.

Meanwhile, the second contact roller 10 is rotated at a peripheral speed faster by some amount of speed ($\Delta V_1$) than the first contact roller 9 (FIG. 16) by the driving from the nonstep variable speed gear 39 wherein a first step speed increase is performed by the actuation of the first pilot motor 49 and is kept waiting at a position spaced from the area where the roll product R being wound is moved to the intermediate station C by the turning of the three spindle turrets 1.

When some length of a given length of the film F (for example, 5–10 winding layers) is wound at the first winding station A, turning power is imparted to the three spindle turrets 1 through the motor 31 and the reduction gear 32 to shift the roll product R at the first winding station to the second winding station B, concurrently with which the first contact roller 9 is oscillated, following the roll product R being shifted and surface winding is performed while maintaining the press contact condition.

At the time when the roll product R reaches the intermediate position C, the second contact roller 10 is oscillated to come in press contact with the roll product R and winding is performed by both first and second contact rollers 9, 10. In this condition, the second contact roller 10 is rotated at a speed faster by the foregoing speed ($\Delta V_1$), whereas the first contact roller 9 is rotated while being subjected to slipping with a clutch 29 incorporated in its driving mechanism.

When the roll product R is further moved to the second winding station B, the first contact roller 9 no longer makes press contact with the roll product R and henceforth, surface winding only by the second contact roller 10 is performed.

When the first contact roller 9 is in the condition of slightly moving clear of the roll product R, the path length instantaneously becomes longer, accompanied by the turning motion of the turrets 1, and the film F is entrained by the roll product R and henceforth reaches the contact line between the second contact roller 10 and the roll product R. As a consequence, entrapment of air is likely to occur, and it is critical to avoid such trouble.

To that end, the winding driving of the second contact roller 10 is performed at a speed increasing by the increment of $\Delta V_1$ at the instant when the first contact roller 9 even slightly moves clear of the roll product R, whereby a higher level of tension is imparted to the film F than the tension imparted so far. Thus occurence of creases as well as entrapment of the air can be avoided.

Thereafter, the first contact roller 9 is oscillated to revert to the side of the first winding station A by means of the aforesaid mechanism composed of the cam 14 so that the path length of the film F may increase linearly in proportion to the turning angle of the three spindle turrets 1. This return oscillation of the first contact roller 9 brings the contact line of the second contact roller 10 and the roll product R into complete agreement with the tangent line of the film F to the roll product R and consequently, entrapment of air is securely prevented by means of the second contact roller 10.

In agreement with the timing of the oscillating return of the first contact roller 9, the second pilot motor 50 is actuated to cause the second contact roller 10 to effect a second step speed increase. That is , the second contact roller 10 is linearly increased in speed, with the speed increment being constant so that at the time of termination of the turning movement when the roll product R reaches the second winding station B, the speed may be increased by a given speed ($\Delta V_2$).

In this way, a winding operation is accomplished while imparting a constant tension to the film F which is developing from the feed roll 5, via the first contact roller 9 and the winding core at the first winding station A to the contact line of the second contact roller 10 to the roll product R, with the path length changing with the lapse of time.

Figure 16:
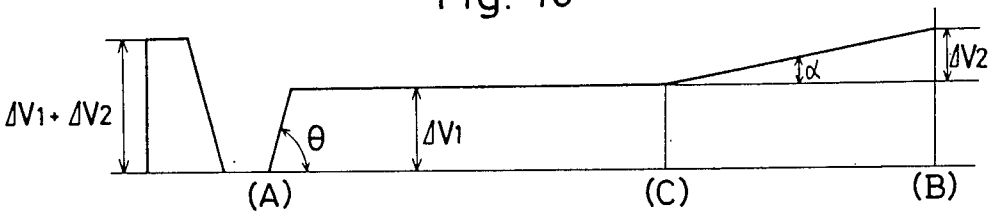
FIG. 16 is a diagram showing a speed control pattern to a second contact roller.

The pattern of the speed control mode to the second contact roller 10 is shown in FIG. 16.

When the roll product R reaches the second winding station B and is wound up fully in a given length, the first contact roller 9 is in contact with the winding core 4 at the first winding station A as shown in FIG. 1. The fully wound state of the roll is inspected as a full winding signal when the full winding length is reached which is preset by means of a preset counter for counting the total rotation number of the feed roller 5 and measuring the winding length, according to which inspection the automatic cutting device and the wrapping device are actuated synchronously to conduct the cutting of the film F and wrapping of the film about a next core at the first winding station A. Thus one cycle of winding operation is finished.

According to the winder of this invention, as described above, the film winding during the turning process of the three spindle turrets 1 is performed, without air being entrapped in the roll product R and tension imparted to the film F is maintained constant consistently from the beginning to the end of the winding operation, hence transparent rolls of good quality can be produced continuously.

The embodiments of the invention in which an exclusive property or privilege is claimed are defined as follows:

1. A multi-spindle winder of a surface winding-center winding system, comprising:

multi-spindle turrets each having a plurality of winding spindles fitted thereon with winding cores located between a first winding station and a second winding station thereon;

a first contact roller on arms oscillatably mounted to make press contact with at least one of said winding cores to wrap a leading end of a given length of a transparent stretch film fed from a feed roller onto said one winding core in order to initiate winding at said first winding station, said first contact roller being rotatably driven while being in contact with said one winding core from said first winding station to an intermediate station between said first and second winding stations;

a second contact roller oscillatably mounted to make press contact with a wound roll transferred by the turning motion of said multi-spindle turrets thereby to wind up the given length of the film into a transparent roll product at said second winding station, said second contact roller being driven to rotate by a drive means and being in contact with the wound roll from said intermediate station to said second winding station and changed over from said first contact roller at said intermediate station;

a cam for contacting said arms which supports said first contact roller for facilitating a receding of said first contact roller from said intermediate station;

means for forcing said first contact roller to return from said intermediate station to said first winding station;

speed control means for controlling the rotation of said drive means of said second contact roller;

film cutting means for severing the fully wound roll, said film cutting means being located rearwardly of said one winding core at said first winding station; and automatic wrapping means for wrapping the leading cut end of the film around an empty winding core, including a film guiding member having an arcuate guide face and air nozzles capable of injecting air rearwardly of the moving area of the film cutting means toward the space between said film guiding member and said empty core;

said cam being actuated interlocking with the turning motion of said multi-spindle turrets and having a guide profile which limits a displacement magnitude of said first contact roller so as to increase the variation magnitude in path length of the film stretching from said feed roller via said first contact roller to said one winding core being wound in proportion to the turning angle of said multi-spindle turrets, said speed control means serving to control said drive means so as to impart, immediately before press contact, a peripheral speed slightly faster than said first contact roller to said second contact roller and, after press contact, a peripheral speed gradually increasing at an increment proportional to the turning angle of multi-spindle turrets during movement from said intermediate station to said second winding station, whereby winding is accomplished under a constant tension without air being entrapped in the roll products.

2. A multi-spindle winder as claimed in claim 1, wherein said film cutting means includes a rail extending laterally and capable of approaching the film travelling toward the second winding station, an air gun, a slider movable back and forth, guided by the rail and capable of running at high speed by air pressure of the air gun, a cutter blade supported on the slider, and a device for returning and locking the slider.

* * * * *